US008196767B2

(12) United States Patent
Fields

(10) Patent No.: US 8,196,767 B2
(45) **Date of Patent: *Jun. 12, 2012**

(54) SMALL DIAMETER CAN END WITH LARGE OPENING

(75) Inventor: Brian Fields, Lemont, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/564,739

(22) Filed: Sep. 22, 2009

(65) Prior Publication Data

US 2010/0065568 A1 Mar. 18, 2010

Related U.S. Application Data

(63) Continuation of application No. 09/857,145, filed as application No. PCT/GB99/03899 on Nov. 24, 1999, now Pat. No. 7,594,585.

(30) Foreign Application Priority Data

Dec. 4, 1998 (GB) ..... 9826602.6

(51) Int. Cl.
*G09F 9/40* (2006.01)

(52) U.S. Cl. ..... 220/269; 220/906

(58) Field of Classification Search ..... 220/269, 220/906

See application file for complete search history.

(56) References Cited

U.S. PATENT DOCUMENTS

| | | | | |
|---|---|---|---|---|
| D218,961 | S | 10/1970 | Kennedy | |
| D243,833 | S | 3/1977 | Markert | |
| 4,084,721 | A | 4/1978 | Perry | |
| 4,465,204 | A | 8/1984 | Kaminski et al. | |
| D387,666 | S | 12/1997 | Wise | |
| D387,987 | S | 12/1997 | Neiner | |
| 5,711,448 | A | 1/1998 | Clarke, III | |
| 5,715,964 | A | 2/1998 | Turner et al. | |
| 5,875,911 | A * | 3/1999 | McEldowney | 220/269 |
| D411,107 | S | 6/1999 | Turner et al. | |
| 5,964,366 | A | 10/1999 | Hurst et al. | |
| 6,024,239 | A | 2/2000 | Turner et al. | |
| 6,065,634 | A * | 5/2000 | Brifcani et al. | 220/619 |
| D448,666 | S | 10/2001 | Fields | |
| 6,330,954 | B1 | 12/2001 | Turner et al. | |
| 7,594,585 | B1 * | 9/2009 | Fields | 220/269 |

FOREIGN PATENT DOCUMENTS

| | | |
|---|---|---|
| DE | 2553835 | 6/1976 |
| EP | 0432659 | * 12/1990 |
| EP | 432659 | 6/1991 |
| GB | 1540229 A | 2/1979 |
| WO | WO 96/37414 | * 11/1996 |
| WO | WO 97/29960 | 8/1997 |
| WO | WO 97/30902 | 8/1997 |

OTHER PUBLICATIONS

Rexam catalogue, 2011.*

(Continued)

*Primary Examiner* — Tri Mai
(74) *Attorney, Agent, or Firm* — Woodcock Washburn LLP

(57) ABSTRACT

A can end having a small diameter center panel and an opening of particular aspect ratio to improve the pourability and drinkability characteristics of the opening, compared to can ends having conventional openings.

7 Claims, 2 Drawing Sheets

OTHER PUBLICATIONS

Letter from K. Bergen (Opponent) 0 1 (Stolle) Responding to Patentee's Submission of Jan. 17, 2005, Sep. 9, 2005,8 pages, with attached Declaration of Kenneth F. Fultz, (Exhibit 2.9), Jul. 1, 2005, Declaration of Timothy A. Fleming, (Exhibit 2. lo), Jun. 30, 2005, Purchase Order No. 26359A of Formatec Tooling Systems, Inc., (Exhibit 2.1 I), 0911 6/96, Declaration of Leslie Talmadge, (Exhibit 2.12), Jul. 29, 2005, Agreement Relating to Purchasing of Ends, 1013 1/97, 5 pages, 202 Diameter Stolle Large Opening End Reference Sheet, Sep. 6, 1996, 1 page, 202 Diameter Stolle Conventional Opening End Reference Sheet, 0311 0197, 1 page, Compound Placement and Dry Film Weight, Apr. 16, 1996, 1 page, Recommended Double Seam Set Up and Operating Specifications for 202121 1×4 13 Multi Necked-In Two Piece Aluminum Beer and Beverage Cans, Mar. 3, 1997, 1 page, Invoice # 07784, from Metal Packaging International, Inc., 0611 7/98, 1 page, Bill of Lading Short Form with Rail Car or trailer No. 532466, 1 page.

Patentee's Reply to an Examination Report in Opposition Proceedings (Communication pursuant to Art. 101 (2), and Rule 58(1) to (4) EPC, Jan. 17, 2005, with amended claims, 10 pages.

Letter from Gill Jennings & Every (Opponent 2) (Rexam) regarding Assertion that Claims Violate Articles 84, 123 (2)' and 123(3) and Lack Inventive Step, Nov. 12, 2004, 1 page.

Letter from K. Bergen (Opponent 01-Stolle) Statement in Response to Patentee's Stolle Machinery Company, LLC., Nov. 12, 2004, with attached Exhibits MI. 1 & MI.2-Documents relating to Opponents Corporate Structure.

Purchase Order No. 26360 of Formatec Tooling Systems, Inc., Sep. 16, 1996, Exhibit 2.4, 1 page.

Order Verification of Stolle Machinery, Exhibit 2.5, 1 page.

Letter to Mr. Tim Fleming of Formatec Tooling Systems, Inc., from Beth Rivera of Stolle, Nov. 4, 1996, Exhibit 2.6, 1 page.

Indented Standard Bill of Material of Stolle Machinery "printout from Stolle's database", Exhibit 2.7, 16 pages.

Customer Order Line Release, Exhibit 2.8, 1 page.

Crown C&S Fax to Stoll Machinery, Exhibit 5.1, 1 page.

Order Verification of Stolle Machinery, Exhibit 5.2, 1 page.

Single Level Standard Bill of Material of Stolle Material, Exhibit 5.3, 2 pages.

Drawing-Material Specification, Exhibit 5.4, 2 pages.

Invoice Number [unreadable] of Stolle Machinery, Inc., Exhibit 5.5, 3 pages.

Letter from James M. Holthaus, Stolle Machinery, Inc. to Crown Cork & Seal regarding "202 Large Score Opening-System "7" Presses in Mankato, Olympia, Batesville-Proposal # EO 03829-96", Jul. 15, 1996, 1 page.

Letter from James M. Holthaus, Stolle Machinery, Inc. to Crown Cork & Seal regarding "Anti-Missile Score Parts Proposal # EO-03901-96, Provisional Opinion of the Opposition Division", Sep. 26, 1996, 6 pages.

Communication Pursuant to Article 101 (2) and Rule 58 (1) to (3) EPC, Jul. 12, 2004, 7 pages.

Reply by the Patentee to the Notice of Opposition, Nov. 11, 2003, with attached Facsimile of Mr. Brian Fields of Crown Cork & Seal to Mr. Wayne Spoltrnan of Stolle, ANNEX CC & S 1, 2 pages.

Memorandum of Mr. Brian Fields of Crown Cork & Seal to Mr. Wayne Spoltrnan of Stolle, ANNEX CC & S 2, 1 page and Crown Drawings 3-3009748-B, 3-3009759-A, E-mail Correspondence between Mr. Brian Field of Crown Cork & Seal and Mr. Wayne Spoltman of Stolle, ANNEX-CC&S 3, 1 page, E-mail Correspondence from Mr. Brian Field of Crown Cork & Seal to Mr. Wayne Spoltman, ANNEX-CC&S 4, 1 page.

Notice of Opposition to European Patent No. 1,135,300 by Rexam Beverage Can Company, Apr. 30, 2003, 15 pages.

Reprint of "Packaging Strategies", Aug. 31, 1996, 14(16), 3 pages.

Beverage Can, End, & Double Seam Dimensional Specifications, Society of soft Drink Technologies, Aug. 1993, Fourth Revision, Sections 1 b and 1 e, 14 pages.

Notice of Opposition to EP Patent No. 1,135,300 by Opponent Stolle Machrnery Company (German Language document with attached English language translation), Apr. 29, 2003, 23 pages.

Letter from Mr. Ken Fultz of Stolle Machinery Company to Mr. Brian Fields of Convn Cork & Seal regarding "Proposal # 1225 A PM-280 Conversion-2002 Superend", E 1.1 ., 1 page, Letter from Mr. Brian Fields of Crown Cork & Seal to Mr. Ken Fultz of Stolle Machinery regarding Stolle Machinery Drawing D-202033( 2 versions), 3 pages, EI .3, Purchase Order by Crown Cork & Seal to Stolle Machinery, 2 pages, E 1.4, Purchase Order 2636 1 of Fornatec Tooling Systems, Inc. to Stolle Machinery, E2.1, 1 page, Stolle Machinery Drawing # S202015,2 pages, E2.2, "Comparison of the Shape of the Opening of a Can End of the LOE 202 Type and of the 202 Superend Type", E2.3, 1 page.

English Translation of EP 0 432 659 A1 dated 064 9/9 1, 18 pages.

Manning equation, http:llw.lmnoeng.comlmanning.htm, 1 page.

English Abstract of EP 432659, Jun. 19, 1991, published on Jun. 19, 1991.

* cited by examiner

SMALL DIAMETER CAN END WITH LARGE OPENING

This is a continuation of U.S. patent application Ser. No. 09/857,145, filed May 31, 2001, which is the National Stage of International Application No. PCT/GB99/03899, filed Nov. 24, 1999, which claims priority to GB Application Number 9826602.6 filed Dec. 4, 1998, the disclosures of which are incorporated herein by reference in their entirety.

BACKGROUND

The present invention relates to can ends having a non-removable tear panel which defines a large opening for improved pour characteristics, so called large opening ends (LOE). In particular, the invention relates to the shape of such large openings in can ends having a reduced diameter centre panel.

Typically, aluminium or steel cans filled with beer, soft drinks or the like are provided with easy open, stay on tab type ends having a non-removable tear panel which is torn and swung down into the can to provide an opening through which the contents of the can may be dispensed. The opening provided in conventional cans is generally small and as a consequence it is not possible to pour the contents from the can in a smooth manner because the liquid tends to be dispensed in small spurts or glugs. This is particularly difficult where the contents are being drunk directly from the can as the glugs mean that the liquid has to be sipped.

Can ends having larger openings have been proposed, for example in U.S. Pat. No. 5,711,448, in order to improve pourability and drinkability. This improved performance is usually obtained by providing openings of larger area than the conventional openings discussed above. The pour characteristics of these large openings allow the contents of the can to be dispensed at higher flow rates than conventional openings, with fewer spurts or glugs. This allows the contents of a can to be drunk directly from the can, in a more natural manner.

Can ends are made in a variety of sizes from 202 to 211 (using conventional can makers' terminology). However, there is continual pressure to reduce the size of can ends. Recently, 206 ends were conventionally used for all beverage cans and these size ends are still used on the majority of beer cans in Europe. However, on cans for soft drinks, 202 ends are now the industry standard in both the US and Europe and there is industry pressure to reduce the remaining 206 ends to 202 ends. Thus, cans are being produced with successively smaller diameter ends in order to provide cost savings through lightweighting.

Furthermore, it has been proposed to reduce the diameter of the centre panel of the can end whilst retaining the nominal can end diameter, as discussed in WO 96/37414. Such can ends have an outer circumferential "hook" which is separated from a smaller diameter centre panel by an inclined side wall. The side wall is inclined at an angle of between 20° to 60° to the plane of the centre panel.

As centre panels become smaller (either through reducing the size of the can end or through the use of inclined side walls) it becomes more difficult to provide an opening having the area considered necessary to obtain improved pouring and drinking performance, due to the reduced distance between the rivet and the side wall of the end panel.

SUMMARY

The aim of the present invention is to provide an easy open, stay on tab can end, having an opening with improved pourability and drinkability characteristics but suitable for use on ends having a smaller diameter centre panel than conventional, standard 202 ends. Hence, the present invention is suitable for use on 202 ends having sloping side walls as previously discussed and on smaller diameter standard ends, such as 200 and below.

Accordingly, the present invention provides an easy open can end comprising a circular centre panel with a rupturable score line therein, the score line defining the periphery of a non-removable tear panel, a non-detachable tab having a nose portion and a rear portion, and a connection between the tab and the centre panel which acts as a pivot about which the tab can be rotated out of the plane of the centre panel, such that in use, the rear portion of the tab is lifted to cause the nose portion of the tab to press down on the tear panel, thereby rupturing the score line and swinging the tear panel out of the plane of the centre panel to create an opening, the opening having a major axis and a minor axis, the minor axis located on a diameter of the centre panel and the major axis located perpendicular to said diameter, characterised in that the diameter of the centre panel is less than 1.835 inches (46.6 mm) and the opening has an area of less than 0.5 square inches (323 $mm^2$) and an aspect ratio (major axis:minor axis) of between 1.3 and 1.7.

All centre panel dimensions quoted in this specification relate to the dimensions of the die used to produce the centre panel. Thus the centre panel diameter quoted is the internal panel diameter of the centre panel.

The inventors have discovered that the pourability and drinkability characteristics of the opening in a can end are affected more by the aspect ratio and orientation of the opening than by its area. Hence, the opening in a can end having a smaller diameter centre panel can be designed with greatly improved pourability characteristics without increasing the area of the opening above the threshold value of 0.5 square inches stipulated in the cited prior art.

The criteria for assessing a good LOE is that the flow rate from the can opening, with a "vent" space above the surface of the liquid, should exceed that which can be swallowed by the average consumer. This allows the average consumer to drink the contents of the can in a natural manner, without any spurts or glugs. When the flow rate from the opening is too low, the consumer will tend to tilt the can further, to increase the flow rate, and this cuts off the air space above the surface of the liquid, causing glugging. Alternatively, in order to obtain smooth pouring, the consumer will have to sip the contents of the can due to the low flow rate.

Considering a can end having an opening in which the minor axis of the opening lies along a diameter of the end and its major axis lies perpendicular to such diameter, significant improvements in pourability may be obtained by providing a tear panel (and hence an opening once the tear panel is torn and swung back into the can) with an aspect ratio of between 1.3 and 1.7 (major axis:minor axis), preferably with an aspect ratio of about 1.5.

When the aspect ratio is below 1.3, the opening in the can tends towards a circular shape as in conventional ends. The flow rate from such openings tends to be low and the consumer then tilts the can further than is desirable to obtain a higher flow rate, resulting in unsatisfactory glugging. When the aspect ratio is above 1.7, the opening in the can tends towards an elongated shape which means that even slight variations in the tilt of the can results in large variations in the flow rate. Hence, at aspect ratios above 1.7, the flow rate from the opening is too sensitive to variations in the tilt of the can. This means that too much precision is required by the consumer to obtain the required flow rate, without blocking the air passage above the surface of the liquid.

Preferably the opening is elliptical, as this is the most suitable shape to provide the required aspect ratio whilst ensuring that the pivotal movement of the tab is sufficient to fracture the score line along its entire length. However, enhancements to the tearing of the score line may be achieved by using an enhanced tab design or by providing a bead configuration which strengthens the centre panel around the score line and tab.

Preferably, the can end also comprises a bead on the tear panel which substantially follows the outline of the score line but which is shaped around the front of the nose of the tab. This bead configuration helps to strengthen the tear panel and prevent it from being distorted as it is opened, thereby assisting rupture of the score line along its entire length.

BRIEF DESCRIPTION OF THE FIGURES

The present invention will now be described, by way of example only, with reference to the accompanying drawings, in which.

DETAILED DESCRIPTION

Figure 1:
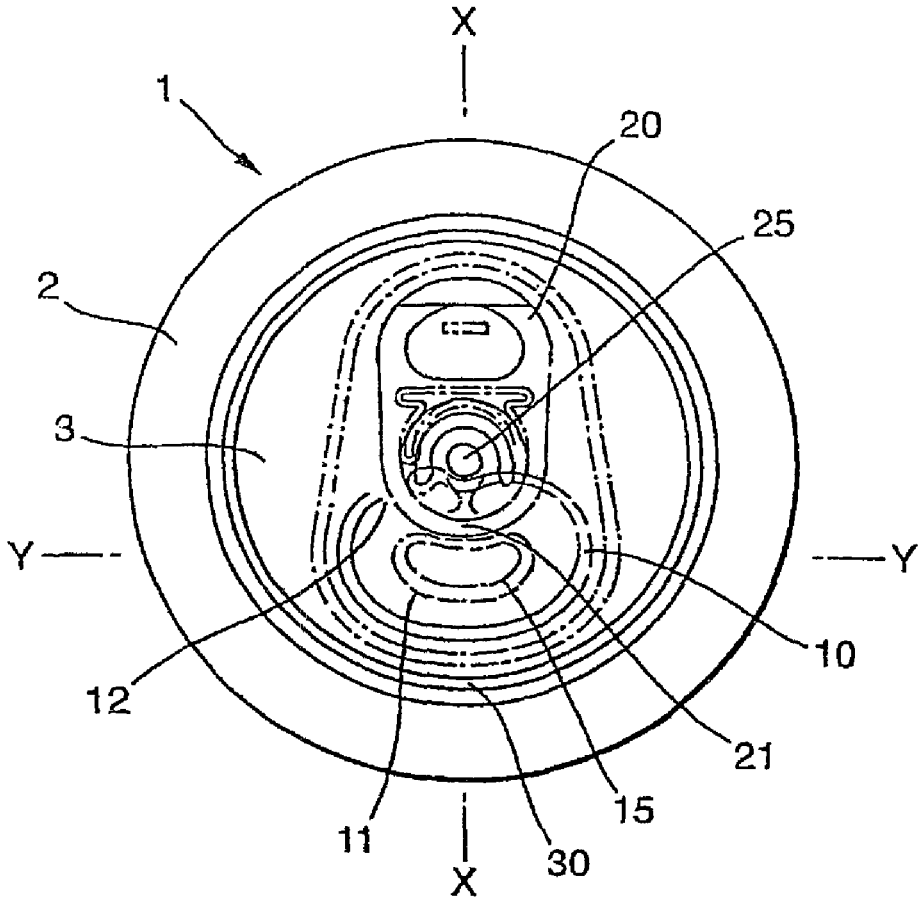
FIG. 1 shows a plan view of one embodiment of a can end according to the invention.
Figure 2:
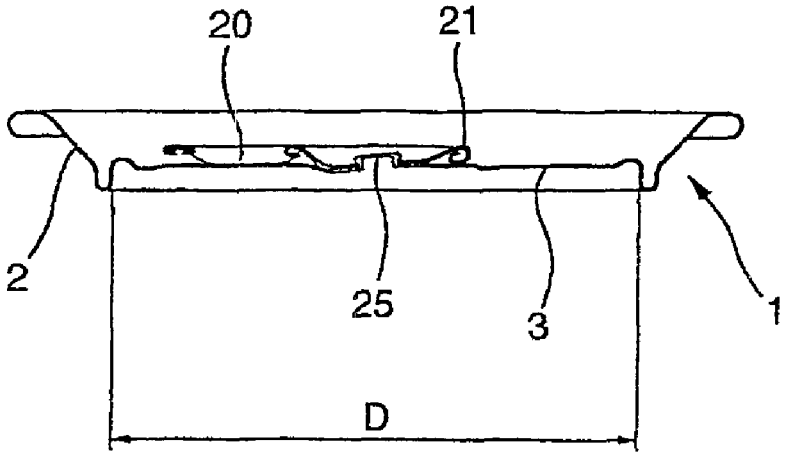
FIG. 2 shows a side section through the can end shown in FIG. 1.

FIGS. 1 and 2 show a can end 1 according to one embodiment of the invention. The can end 1 has a sloping side wall 2 and a centre panel 3 of reduced diameter, D (as shown in FIG. 2). The centre panel 3 is marked with a rupturable score line 10 which defines a tear panel 11. The score line 10 has an open configuration and the unmarked area between the start and finish of the score line 10 defines a hinge 12. The can end 1 also comprises a tab 20 having a nose portion 21 at one end, which extends over the edge of the tear panel 11. The other end of the tab 20 is provided with a rear, lifting portion. The tab 20 is connected to the centre panel 3 by a rivet 25 positioned adjacent to the score line 10, on the other side of the score line to the nose of the tab 21. The tear panel 11 is provided with a closed, raised bead 15 which follows the periphery of the tear panel 11 and the nose of the tab 21.

To open the can, the rear portion of the tab 20 is raised and the tab 20 pivots out of the plane of the centre panel 3 about the rivet 25, pressing the nose of the tab 21 against the tear panel 11 adjacent to the score line 10. This movement initially ruptures the portion of the score line 10 which extends below the tab 20 and allows any gas which has built up within the can to vent (the "pop"). As the tab 20 is raised further, rupture of the score continues around the periphery of the score line 10 and the tear panel 11 swings out of the plane of the centre panel 3, into the body of the can about the hinge portion 12, defining an opening in the can end 1. The bead 15 on the tear panel 11 provides stiffness and prevents the tear panel 11 from distorting as the end 1 is being opened. This in turn assists the propagation of the rupture of the score line 15 around the periphery of the tear panel 11 to the hinge portion 12. The resultant opening has a minor axis, which lies on a diameter X-X of the end 1 and a major axis Y-Y, which lies perpendicular to this diameter, at the point where the opening has its maximum dimension along this axis.

As shown in FIG. 1, when the centre panel 3 is of reduced diameter, the minor axis of the opening is restricted by the reduced distance between the rivet 25 and the start of the side wall 30. This means that it is difficult, to obtain an opening having an area of greater than 0.5 square inches (323 $mm^2$), as stipulated in the prior art as the size of opening required to obtain improved pouring performance. However, the applicants have found that improved pouring performance can be obtained from an opening having an area less than 0.5 square inches (323 $mm^2$), provided the aspect ratio of the opening (major axis:minor axis) is between 1.3 and 1.7.

The applicants have carried out a number of tests to measure the pour rates of cans fitted with ends having various size apertures and centre panels. In these tests, the test can was opened and then rotated from a vertical to horizontal orientation in three seconds. The contents of the can were allowed to flow freely from the can and the flow rate measured at predetermined, constant time intervals.

Figure 3:
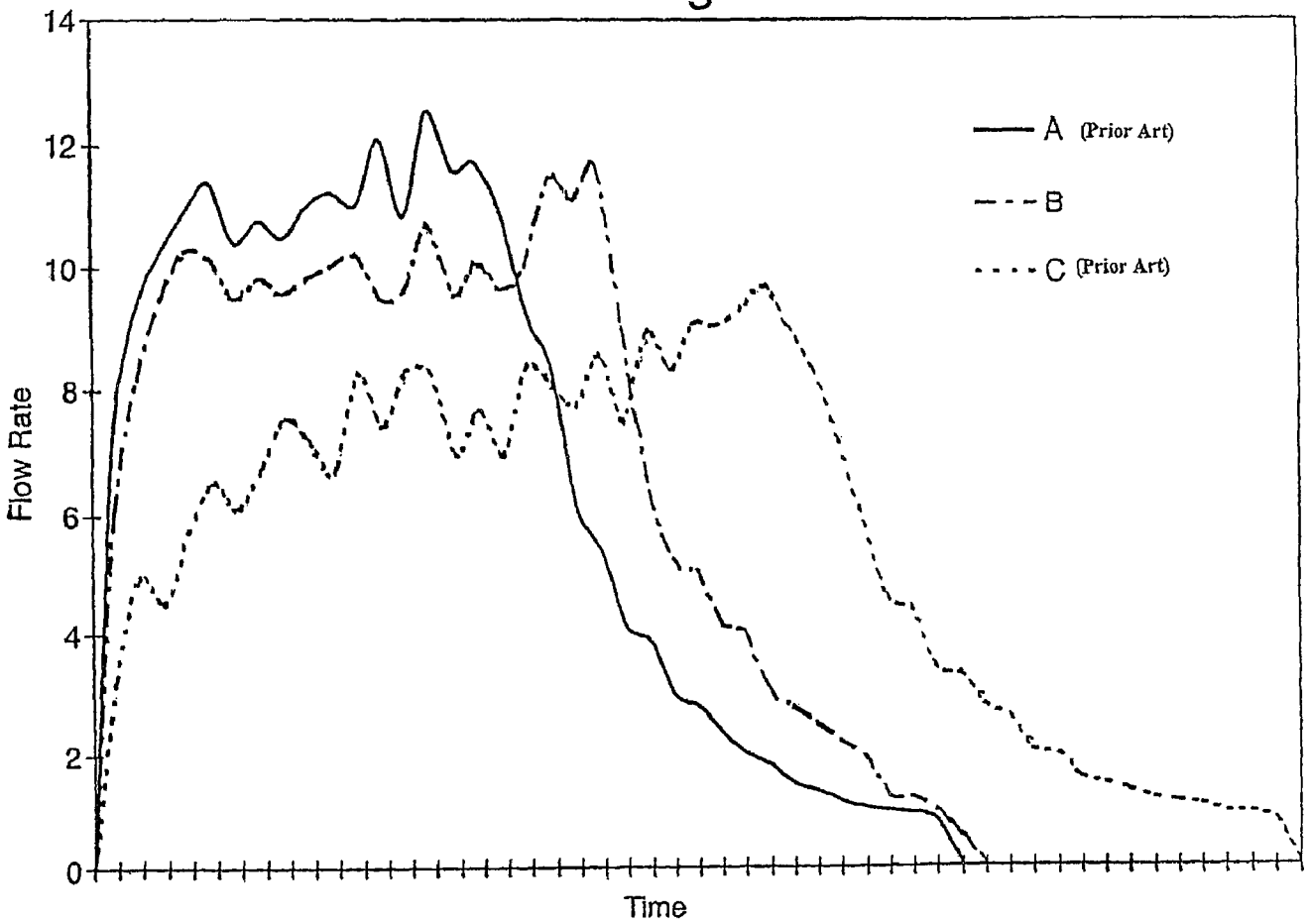
FIG. 3 shows pour rate data for various 202 ends with different aperture sizes (showing 202 Standard, 202 LOE and 202 LOE with reduced diameter centre panel).

FIG. 3 shows the results of these tests for three 202 ends with differently configured centre panels and aperture size: A conventional 202 LOE, A; a 202 LOE according to the invention with reduced diameter centre panel, B and a conventional 202 end with standard size opening, C. As shown in FIG. 3, the conventional 202 end, C, with an opening of area 0.450 square inches (290 $mm^2$) and an aspect ratio of 1.1, exhibited fluctuations in flow rate (glugging) and took the longest time to reach its maximum flow rate. The 202 LOE, A, with an opening of area 0.596 square inches (384.5 $mm^2$) and an aspect ratio of 1.47, showed far fewer flow rate fluctuations and reached a significantly higher maximum flow rate in the least time. However a 202 end according to the invention, B, having a reduced diameter centre panel and an opening of area 0.487 square inches (314 $mm^2$) and an aspect ratio of about 1.5, was found to exhibit significantly improved pouring characteristics (with fewer flow rate fluctuations and improved flow rate versus time profile) compared to the standard 202 end. The flow rate versus time profile for the 202 LOE according to the invention, B, shows a performance comparable to that of the known 202 LOE, A.

The invention claimed is:

1. An easy open can end having improved flow characteristics, said end comprising:

a circular center panel with a rupturable score line therein, the score line defining the periphery of a non-removable tear panel, a non-detachable tab having a nose portion and a rear portion; and a connection between the tab and the center panel which acts as a pivot about which the tab can be rotated out of the plane of the center panel, such that in use, the rear portion of the tab is lifted to cause the nose portion of the tab to press down on the tear panel, thereby rupturing the score line and swinging the tear panel out of the plane of the center panel to create an opening, the opening having a major axis and a minor axis, the minor axis located on a diameter of the center panel and the major axis located perpendicular to said diameter, wherein the diameter of the center panel is less than 1.835 inches (46.6 mm) and the opening has an area of less than 0.5 square inches (323 $mm^2$) and an aspect ratio (major axis:minor axis) of between 1.3 and 1.7.

2. An easy open can end according to claim 1, wherein the opening is elliptical.

3. An easy open can end according to claim 1, further comprising a side wall that is inclined at an angle of between 20° and 60° to the plane of the center panel.

4. An easy open can end according to claim 1, wherein the tear panel further comprises a bead which substantially follows the periphery of the score and the nose portion of the tab.

5. An easy open end according to claim 4, wherein the bead on the tear panel is closed.

6. An easy open end according to claim 1, wherein said end exhibits a higher first peak of flow rate per unit opening area compared with the first peak of flow rate per unit opening area of an end having an aspect ratio of 1.47 and an opening area of 0.596 square inches and compared with the first peak of flow rate per unit opening area of an end having an aspect ratio of 1.1 and an opening area of 0.450 square inches.

7. An easy open end according to claim 1, wherein said end exhibits a higher first peak of flow rate per unit opening area compared with the first peak of flow rate per unit opening area than an end having an aspect ratio between 1.3 and 1.7 and an opening area of greater than 0.5 square inches.

* * * * *